United States Patent [19]

Hunt et al.

[11] 4,073,267

[45] Feb. 14, 1978

[54] VAPOR GENERATOR

[75] Inventors: Paul S. Hunt, Poway; James P. Elliott, San Diego, both of Calif.; Johann F. Gulich, Winterthur; Max H. Weber, Wiesendangen, both of Switzerland; Jack S. Yampolsky, San Diego; George E. Lockett, La Jolla, both of Calif.

[73] Assignee: General Atomic Company, San Diego, Calif.

[21] Appl. No.: 716,115

[22] Filed: Aug. 20, 1976

Related U.S. Application Data

[63] Continuation-in-part of Ser. No. 619,317, Oct. 3, 1975, abandoned.

[51] Int. Cl.[2] ..... F22B 1/18; F22G 1/00

[52] U.S. Cl. ..... 122/32; 122/483

[58] Field of Search ..... 122/32, 33, 34, 483

[56] References Cited

U.S. PATENT DOCUMENTS

| | | | |
|---|---|---|---|
| 3,164,133 | 1/1965 | Pacault et al. | 122/34 |
| 3,267,907 | 8/1966 | Glausser et al. | 122/483 |
| 3,279,439 | 10/1966 | Ammon | 122/34 |
| 3,893,427 | 7/1975 | Barratt | 122/32 |
| 3,923,008 | 12/1975 | Beckmann et al. | 122/34 |

*Primary Examiner*—Kenneth W. Sprague
*Attorney, Agent, or Firm*—Fitch, Even, Tabin & Luedeka

[57] ABSTRACT

A vapor generator and heat exchanger, particularly suited for use in a substantially cylindrical cavity in a pressure vessel includes high and low temperature sections of the vapor generator positioned coaxially with the annular outer section terminating a distance from the end of the central or axial section to form at the one end an annulus arranged between the central or axial section and the pressure vessel wall. A plurality of reheater or heat exchanger sections and various inlet and outlet conduits are positioned in the annulus. A heating fluid is directed first transversely over the tubes of the reheater sections, then along the tubes of the central or axial high temperature section after passing over the outer annular low temperature section.

11 Claims, 4 Drawing Figures

VAPOR GENERATOR

This is a continuation-in-part of U.S. application Ser. No. 619,317, filed by Hunt et al, on Oct. 3, 1975, and assigned to the assignee of the present invention, now abandoned.

This invention relates to vapor generators such as are used in connection with the production of steam for driving steam turbines. More particularly, the invention relates to a steam generator which is especially suited for use with a gas-cooled nuclear reactor in an electrical power generating facility.

Since the advent of nuclear power reactors, substantial steps have been taken toward the efficient and economical production of electrical power from thermal energy derived by these reactors. An important factor in the attainment of this goal is the operation of such reactors at temperatures sufficiently high to enable the direct production of steam at temperatures and pressures suitable for high efficiency operation of steam turbines. In this connection, present day reactor technology has led to the development of high temperature, gas-cooled reactors, which, when employed with a suitable steam turbine system, have the capability of producing electrical power of a quantity and at a cost which meet requirements of the utility industry.

In general, nuclear power plants employing high temperature, gas-cooled reactors enclose the reactor in a pressure vessel through which a gas coolant, such as helium or carbon dioxide, is circulated to withdraw thermal energy liberated by the reactor. Steam for the operation of the turbines is normally obtained by the transfer of heat from the coolant to the fluid of a water/steam system. Conventionally, such heat transfer is accomplished in a steam generator wherein the thermal energy withdrawn from the reactor is utilized to produce superheated steam.

In such a gas-cooled reactor/generator system, it is frequently desirable that the gas make only a single pass through the steam generator before being returned to the reactor. It is therefore important that the greatest possible amount of heat be withdrawn from the gas in order to achieve maximum efficiency. It is also important, however, that there be as little restriction as possible to gas flow in order that work expended in transporting the gas through the system be held to a minimum. Where, for various reasons including structural economy, the steam generator is included in the same pressure containment vessel as the reactor itself, it is also important that the size of the generator be minimized and that the steam generator or sections thereof be readily removable and replaceable through necessarily restricted openings in the containment vessel. Finally, for reasons of structural economy and plant efficiency, it is necessary to have steam pressure exceed primary coolant pressures. To limit pressure buildup in the primary coolant in the event of a steam/primary coolant boundary failure, large steam pipes are terminated at the reactor vessel wall and interconnected with the heat exchanger bundles by tubing in order to limit or minimize the amount of leakage.

Where the steam generator is contained in a special cavity within a prestressed concrete reactor vessel, the routing of unheated tubing from pipe connections at the reactor vessel wall to the ends of the tube bundles results in uneconomical use of both tubing and reactor vessel cavity volume. Accordingly, designs have been developed using cross-over tube connections between the low temperature and high temperature sections and the reheater sections described above at the ends thereof opposite the steam/water pipe connections, thereby reversing the general direction of water/steam flow and minimizing the lengths of unheated tubing.

A problem in the design of steam generators of the type described is that tubes therein of different configurations and lengths frequently have different thermal expansion characteristics. Cross-over connections between tubes of different types therefore must allow for a certain degree of differential expansion. To provide for this, prior art construction sometimes have required complex and intertwining arrangements of unheated tube sections thereby joining steam generator and reheater sections into one large assembly. By locating thermal expansion means at the cross-overs, the complex intertwining may be eliminated and manufacturing span times significantly reduced.

Shipping requirements may severely restrict the size of a steam generator which may be fabricated at a location remote from the location where it is to be installed. Many prior art steam generator designs therefore required a high degree of field fabrication at an on-site facility, increasing their manufacturing times, particularly where complex and intertwining arrangements of tubes are employed. By locating thermal expansion means at the cross-overs to completely eliminate intertwining and providing separate steam generator and reheater sections, field fabrication is minimized and shipping facilitated.

It is therefore an object of the present invention to provide an improved vapor generator.

Another object of the invention is to provide an improved vapor generator which is particularly suited for use in a substantially cylindrical cavity in a pressure vessel.

A further object of the invention is to provide a vapor generator having provision for separability of portions thereof for ease of shipping and manufacturing.

It is a further object of the invention to provide a vapor generator in which the length of tubing used in unheated sections and expansion zones is minimized.

It is an even further object of the invention to employ internal cross-overs between sections of the steam generator and reheater for accomplishing the abovenoted objects.

Other objects of the invention will become apparent to those skilled in the art from the following description, taken in connection with the accompanying drawings wherein.

Figure 1:
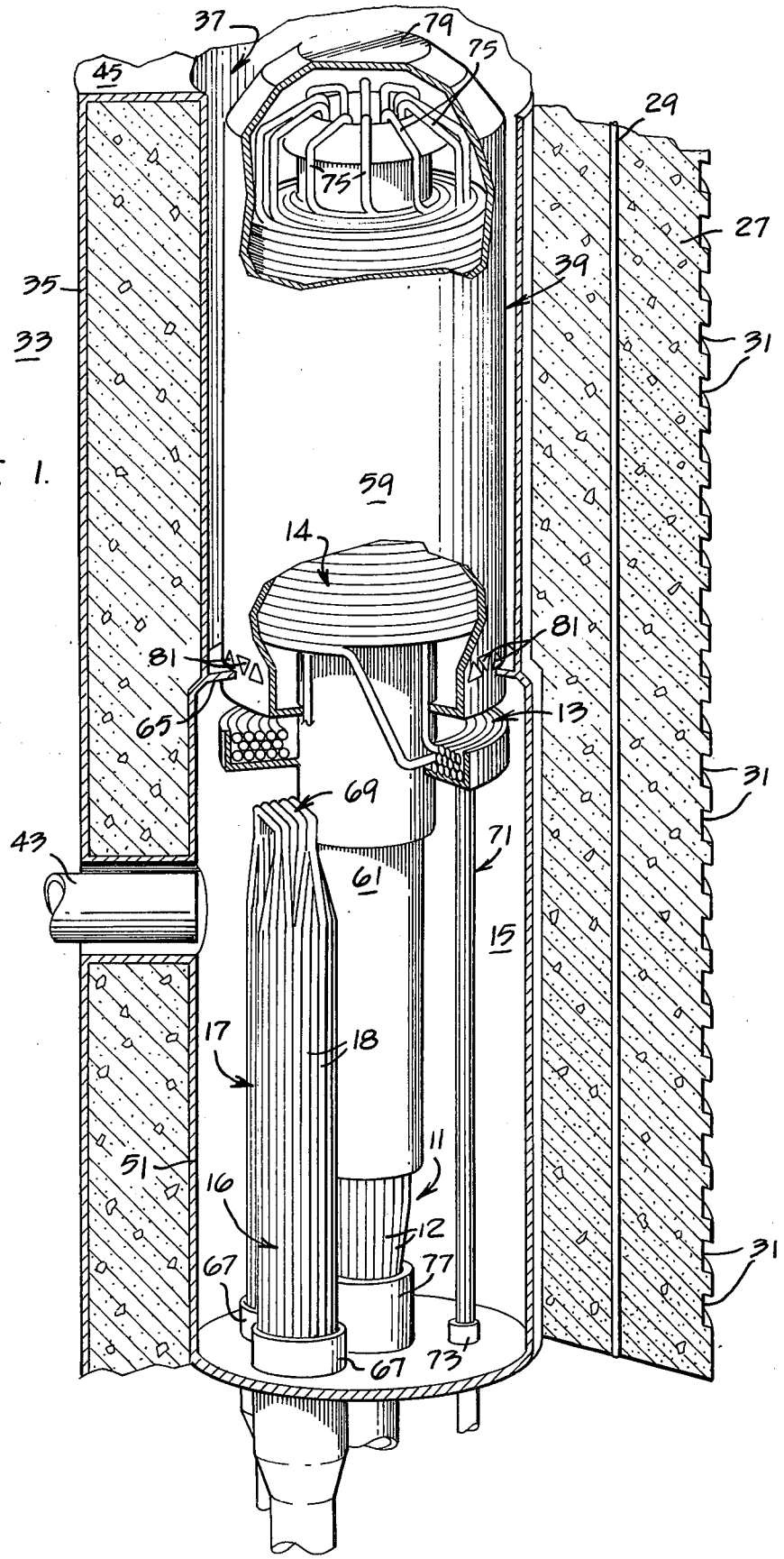
FIG. 1 is a perspective view, with parts broken away, illustrating a vapor generator constructed in accordance with the invention.

Very generally, the vapor generator of the invention comprises a high temperature section 11 having a plurality of elongated substantially straight tubes 12 arranged parallel with each other to form an elongated tube bundle. An unheated feed water expansion tube section 13 is connected with a low temperature section of heated tubes 14 which are substantially helical and which form an annular tube bundle positioned coaxially of the high temperature section. The axial dimension of the low temperature section is substantially less than that of the high temperature section and the low temperature section is positioned toward one end of the high temperature section to form an annular space 15.

Reheater sections 16 and 17 are positioned in the annular space 15, each reheater section having a plurality of elongated substantially straight tubes 18 arranged parallel with each other to form an elongated tube bundle of an axial length substantially less than that of the high temperature section. The axes of the reheater sections 16 and 17 are oriented substantially parallel with each other and with the axes of the high temperature section 11.

In operation, a heating fluid is directed first transversely over the tubes of the reheater sections 16 and 17, then along the tubes of the high temperature section 11 toward the one end thereof and finally over the helical tubes of the low temperature section 14 in a direction parallel with the axis of the high temperature section and away from the one end thereof.

Referring now more particularly to the drawings, a portion of a nuclear reactor system incorporating the invention is shown. The nuclear reactor system includes a prestressed concrete pressure vessel 27, suitably supported by means not illustrated, within an appurtenant structure, also not illustrated. Prestressing tendons 29 extend axially through the concrete of the pressure vessel 27, which is generally cylindrical in form. A plurality of annular grooves 31 are formed in the outer surface of the pressure vessel for accommodating circumferential prestressing bands, not illustrated.

The interior of the pressure vessel 27 includes a main chamber 33 in which a reactor core, not illustrated, is supported. The chamber 33 is provided with a liner 35 of suitable metal anchored to the concrete. The core of the reactor is of the so-called gas-cooled type. Provision is made for circulating a coolant gas, such as helium or carbon dixoide, over the reactor core, not shown, to raise the temperature of the gas. The gas is then circulated over one or more heat exchangers or vapor generators to produce steam or other vapor for operating machinery to generate electricity. Circulating gas is then returned to the core to be heated once again.

In the illustrated reactor system, the main chamber 33 is surrounded by a plurality of circumferentially spaced chambers 37, only one of which is illustrated in the drawings. Each chamber 37 is cylindrical in shape and extends vertically within the reactor vessel, having its axis parallel with the axis of the reactor vessel. A vapor generator and a coolant circulator are disposed in each of the chambers 37, as indicated in the drawings at 39.

Coolant gas is conducted from the main chamber 33 to the chamber 37 through a horizontal duct 43. The coolant is returned to the chamber 33 for recirculation over the reactor core through a similar horizontal duct partially illustrated in FIG. 1 at 45. Suitable closures (not shown) are provided at the upper ends of the chambers 33 and 37.

Figure 2:
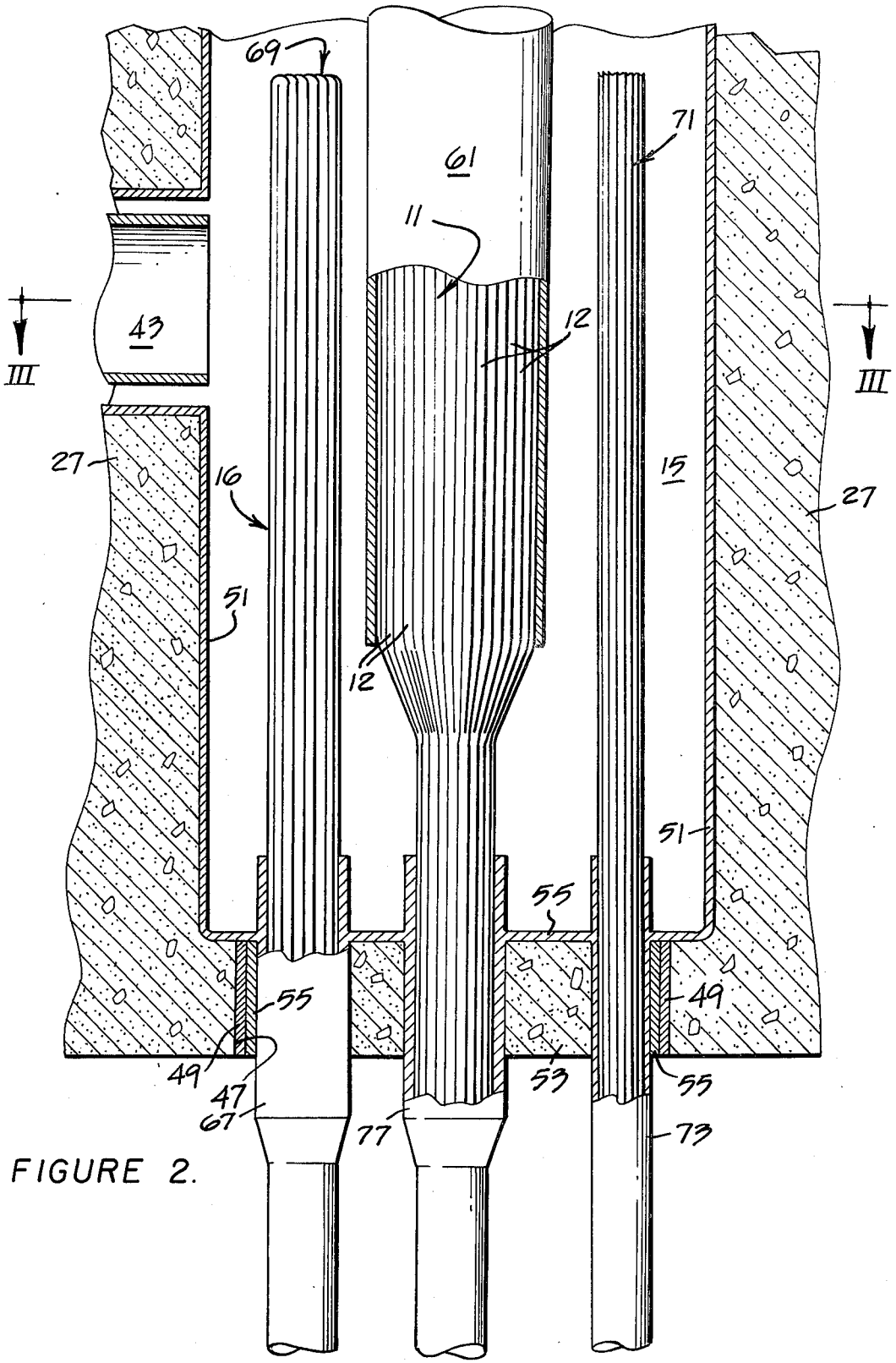
FIG. 2 is a view taken through the lower end of the vapor generator, along section line 2—2 of FIG. 3.

The chamber 37 is accessible from the lower end of the pressure vessel 27 through penetrations 47 which may be best seen in FIG. 2. Each penetration 47 is provided with a metal liner 49 which extends upward and is welded to a metal liner 51 for the chamber 37. Each penetration 47 is closed and sealed by a concrete plug 53 having an inner metal liner 55. Suitable penetrations are provided in the plug 53 for entry of the various water and steam pipes, explained below, into the chamber 37 for conducting water and steam to and from the vapor generator 39.

The reheater bundles or sections 16 and 17 of tubes 18 are positioned toward the lower end of the chamber 37 and are supported by a suitable frame of metal plates or the like (not illustrated). Positioned above the reheater tube bundles is the feed water expansion tube section 13 and low temperature helical coil section 14 arranged thereabove with an annular shape. The section 14 is provided with a housing 59. The bundle 14 comprises economizer, evaporator and initial superheater sections of the steam generator.

The high temperature section or tube bundle 11 comprised of a plurality of elongated straight tubes 12 is positioned in the space defined by the annular tube bundle 14. A housing 61 is formed surrounding the tube bundle 11. The housings 59 and 61 are supported by a mounting flange 65 secured to the prestressed concrete vessel 27 and extending into the chamber 37.

The annular space between the lower end of the housing 59 and the surrounding chamber liner 51 is blocked by means of the annular mounting flange 65.

Reheater fluid is supplied to and exits from the reheat tube bundles 16 and 17 through headers or tube sheets 67. The reheat tubes of the hot and cold reheater tube sections are interconnected by hairpin shaped crossover tubes indicated generally at 69.

Feed water for the steam generator is supplied through feed water inlet tubes 71 which pass upwardly through the space 15 and connect with the tubes 14. A header or tube sheet 73 communicates the feed water to the tubes 71. Outflow at the top of the bundle 14 passes to the upper end of the tube bundle 11 through crossover tubes 75 which are flexible to accommodate differences in thermal expansion between the tube bundles 11 and 14. Superheated steam exits the lower end of the tube bundle 11 through a superheater header or tube sheet 77.

Figure 3:
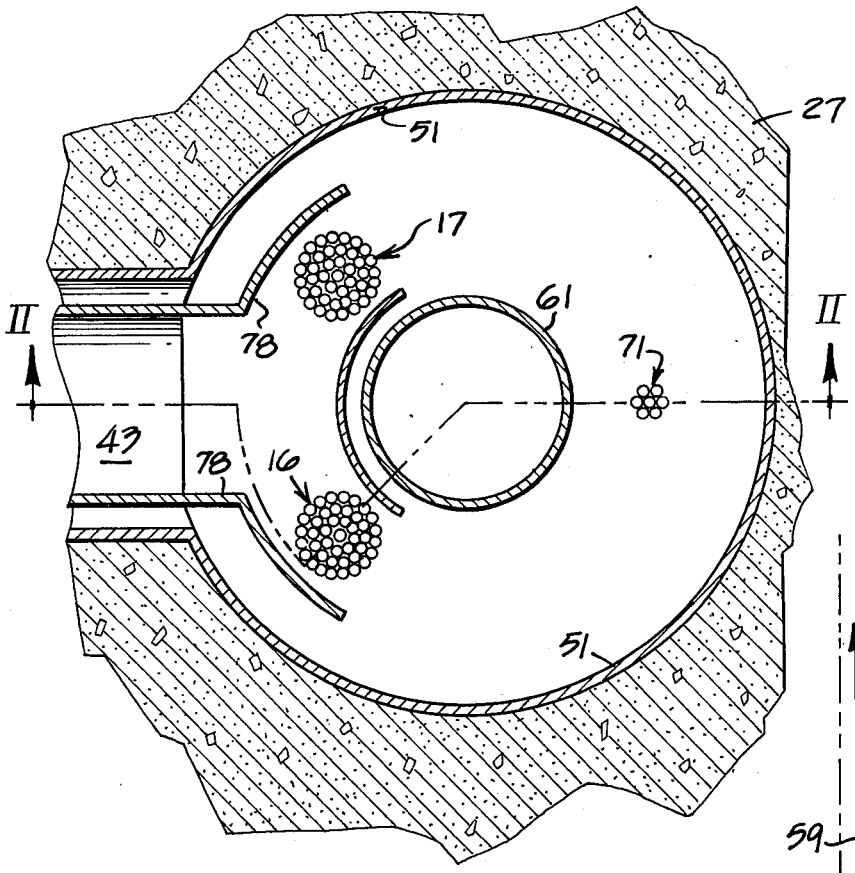
FIG. 3 is a plan view of the reheater section of the vapor generator, taken along section line 3—3 of FIG. 2.
Figure 4:
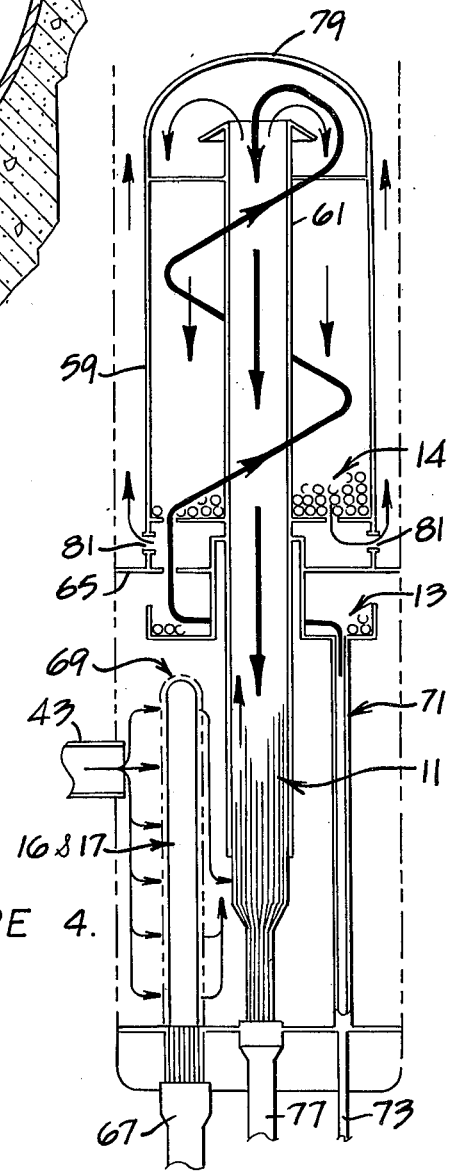
FIG. 4 is a schematic diagram illustrating the general lay-out and coolant flow of the vapor generator of FIG. 1.

Incoming hot gas from the reactor core enters the chamber 37 through the duct 43. The hot gas is directed transversely over the tubes 18 in the bundles 16 and 17 by inlet shrouds 78 (FIG. 3). The gas is then directed toward the lower end of the space 15 and then upwardly through the housing 61 along the tubes in the tube bundle 11. An inverted cup-shaped, gas flow-deflection plate 79 is arranged above the upper end of the housing 61 and forms part of the housing 59. The gas passes through the space between the upper open end of the housing 61 and the plate 79 and is then directed downwardly over the helical tubes in the tube bundle 14. After passing over the helical tubes in the tube bundle 14, the gas passes through ports 81 in the outer wall of the housing 59 and passes upwardly between the housing 59 and the wall or liner 51 of the chamber 37 to the upper cross duct 45, after passing through the coolant circulator (not shown).

In a practical gas-cooled reactor system, each of the steam generators with integral reheaters of the type illustrated may be sized, from example, in the nominal range of 500 MW thermal capacity. The steam generators may supply main steam and reheat steam to a conventional 165 bar/510° C/538° C reheat turbine generator set. The core coolant may be maintained at approximately 48 bars pressure at full power conditions. Each primary coolant loop consisting of a steam generator with its associated helium circulator may provide sufficient pressure head to overcome total primary loop pressure losses of about 1380 mbars of which 450 mbars are allocated to the steam generator under full load operating conditions. The steam generator of the invention therefore easily accommodates overall plant optimization considerations, including those involving pressure vessel and containment building size. Also the steam generators may be easily shop-assembled in units which can be shipped by either barge or rail consistent with restrictions on the overall envelope of the steam generator units.

To ease shipping and shorten manufacturing span times, the steam generator of the invention is readily divided into two major sub-assemblies, namely the main steam section and the overall reheater section. The U-tube reheater sections in combination with the helically coiled economizer, evaporator, presuperheater and the straight-tube finishing superheater are in keeping with the requirements for a compact design and minimize unheated tube surface requirements to the greatest extent possible.

The cross-over tubes 69 from the cold to the hot legs of the reheater sections, as well as the cross-over tubes 75, are located internally within the active gas flow path and thus accommodate the necessary differential expansion between these two heating surface sections.

More particularly, the generator of the invention may be constructed with an envelope of 4077 mm diameter and 18,644 mm height. Because the steam and water piping is routed to the bottom of the pressure vessel and connects to the lower end of the steam generators through penetrations in the reactor vessel, the gas circulators may fill all of the steam generator cavity above the generators.

The high pressure tube sheets, economizer inlet and superheater outlet, may be equipped with integral restrainer/flow restrictor cylinders which will prevent consequential failures and excessive leakage of water into the primary coolant in the event of rupture of the steam or water pipes connected to the tubesheet inside the pressure vessel.

If the main steam tubes 12 and 14 are essentially of equal length, respectively, equal steam-side flow distribution and corresponding uniform steam outlet temperatures are assured. This arrangement requires longitudinal tube spacing variations between the individual tube rows of the helical coils while maintaining uniform height for all tube helices. The transverse tube spacing is maintained constant. The straight tube finishing superheater 11, in straight counterflow to the coolant gas, is arranged to provide equal helium flow area around each tube resulting in an irregular circular tube pattern.

To increase operating stability, close to full operating pressure may be maintained in the main steam section during all boiling conditions. To meet the above requirements, the main steam section may contain a portion of reduced diameter lead-in tubing between the feed water tube sheet and the economizer inlet. Also, it may contain an enlarged diameter straight-tube finishing superheater to acheive the ratio of inlet to outlet steam pressures required for boiling stability.

Turning vanes, not shown, may be provided at the reheater inlet and at the top of the steam generator to assure good gas distribution over the two reheater legs and at the inlet to the helically coiled main steam bundle.

Various modifications of the invention in addition to those shown and described herein will become apparent to those skilled in the art from the foregoing description and accompanying drawings. Such modifications are intended to fall within the scope of the appended claims.

What is claimed is:

1. A vapor generator comprising, a high temperature section having a plurality of substantially straight tubes parallel with each other forming an elongated tube bundle, a low temperature section having a plurality of substantially helical tubes forming an annular tube bundle positioned coaxially of said high temperature section, said low temperature section having an axial dimension substantially less than that of said high temperature section and being positioned toward one end thereof, a plurality of reheater sections each having a plurality of elongated substantially straight tubes parallel with each other forming an elongated tube bundle of an axial length substantially less than that of said high temperature section, said reheater sections having their axes oriented substantially parallel with each other and with the axes of said high temperature section and being positioned toward the end of said high temperature section opposite said one end, and means for directing a heating fluid first transversely over the tubes of said reheater sections, then along the tubes of said high temperature section toward said one end thereof, then over the helical tubes of said low temperature section in a direction parallel with the axis of said high temperature section and away from said one end thereof.

2. A vapor generator according to claim 1 further comprising outlet conduit means for said high temperature section extending axially from the end of said high temperature section opposite said one end parallel with at least a portion of said reheater sections, and including inlet conduit means for said low temperature section extending parallel with the axis of said low temperature section toward the end of said high temperature section opposite said one end parallel with at least a portion of said reheater sections.

3. A vapor generator according to claim 2 further comprising coaxial inlet and outlet conduit means for said reheater sections extending axially thereof on the sides thereof opposite the sides toward said one end of said high temperature section.

4. A vapor generator according to claim 1 and further comprising cross-over means for interconnecting said substantially straight tubes of said high temperature section and said substantially helical tubes of said low temperature section, said cross-over means being internally arranged within the flow path of the heating fluid.

5. A vapor generator according to claim 1 further comprising additional cross-over means for interconnecting said substantially straight tubes in one of said reheater sections with substantially straight tubes in another reheater section, said additional cross-over means being internally arranged within the flow path of the heating fluid.

6. In a substantially cylindrical cavity in a pressure vessel, a vapor generator comprising, a high temperature section having a plurality of elongated substantially straight tubes parallel with each other forming an elongated tube bundle and lying generally along the axis of the cylindrical cavity, a low temperature section having a plurality of substantially helical tubes forming an annular tube bundle positioned coaxially of said high temperature section, said low temperature section having an axial dimension substantially less than that of said high temperature section and being positioned toward one end thereof leaving an annulus at the end of said high temperature section opposite said one end between said high temperature section and the wall of the cylindrical cavity, a plurality of reheater sections positioned in said annulus, each of said reheater sections having separate inlet and outlet conduit means, and means for directing a heating fluid first transversely over the tubes of said reheater sections, then along the tubes of said high temperature section toward said one end thereof, then over the helical tubes of said low temperature section in a direction parallel with the axis of said high temperature section and away from said one end thereof.

7. A vapor generator according to claim 6 further comprising outlet conduit means for said high temperature section extending axially from the end of said high temperature section opposite said one end parallel with at least a portion of said reheater sections.

8. A vapor generator according to claim 6 further comprising inlet conduit means for said low temperature section extending parallel with the axis of said low temperature section toward the end of said high temperature section opposite said one end.

9. A vapor generator according to claim 6 wherein each of said reheater sections is of generally cylindrical shape having is axis oriented parallel with the axis of the cylindrical cavity.

10. A vapor generator according to claim 6 further comprising cross-over means for interconnecting said substantially straight tubes of said high temperature section and said substantially helical tubes of said low temperature section, said cross-over means being internally arranged within the flow path of the heating fluid.

11. A vapor generator according to claim 10 and further comprising additional cross-over means for interconnecting adjacent reheater sections, said additional cross-over means being internally arranged within the flow path of the heating fluid.

* * * * *